United States Patent [19]

Scheurecker et al.

[11] 4,074,745

[45] Feb. 21, 1978

[54] STARTER BAR FOR GUIDING AND EXTRACTING CAST STRANDS OF VARIOUS THICKNESSES

[75] Inventors: Werner Scheurecker; Alois Scheinecker, both of Linz, Austria

[73] Assignee: Vereinigte Osterreichische Eisen- und Stahlwerke - Alpine Montan Aktiengesellschaft, Linz, Austria

[21] Appl. No.: 757,466

[22] Filed: Jan. 7, 1977

[30] Foreign Application Priority Data

Jan. 16, 1976 Austria ..... 266/76

[51] Int. Cl.[2] ..... B22D 11/08

[52] U.S. Cl. ..... 164/446

[58] Field of Search ..... 164/274, 87, 82; 403/113, 362

[56] References Cited

U.S. PATENT DOCUMENTS

| | | | |
|---|---|---|---|
| 3,351,125 | 11/1967 | Colombo | 164/274 |
| 3,429,366 | 2/1969 | Cruger | 164/274 |
| 3,485,292 | 12/1969 | Grothe | 164/274 |
| 3,521,697 | 7/1970 | Niskovskikh | 164/274 |

*Primary Examiner*—Francis S. Husar
*Assistant Examiner*—John S. Brown
*Attorney, Agent, or Firm*—Brumbaugh, Graves, Donohue & Raymond

[57] ABSTRACT

A starter bar for guiding and extracting cast strands of various thicknesses in continuous casting plants with arcuate guiding paths supporting the strands at opposite sides is comprised of pivotally connected link bodies arranged one behind the other. The bar has a thickness corresponding to the smallest or slightest thickness of the strands. Also, exchangeable locking pieces are provided between individual ones of the link bodies to assure that the starter bar is guided between the guiding paths without play.

5 Claims, 5 Drawing Figures

FIG. 3
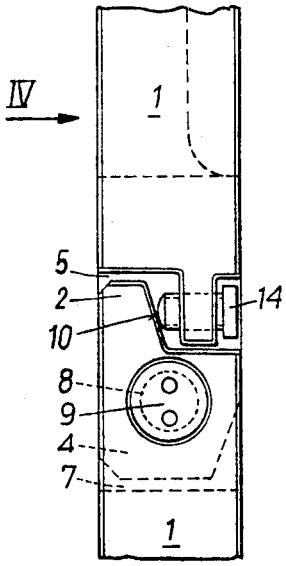
FIG. 4
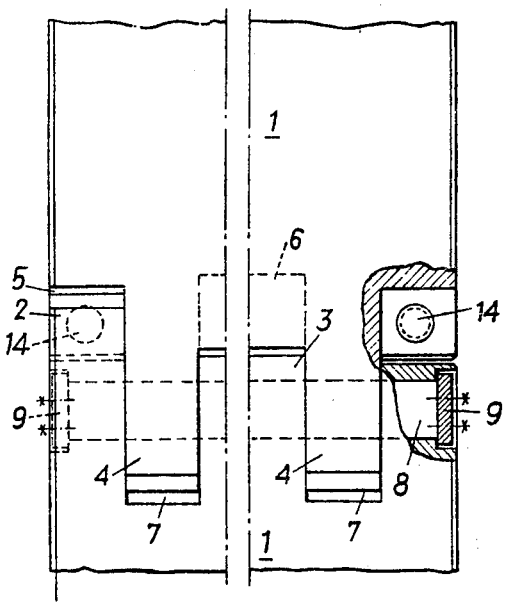
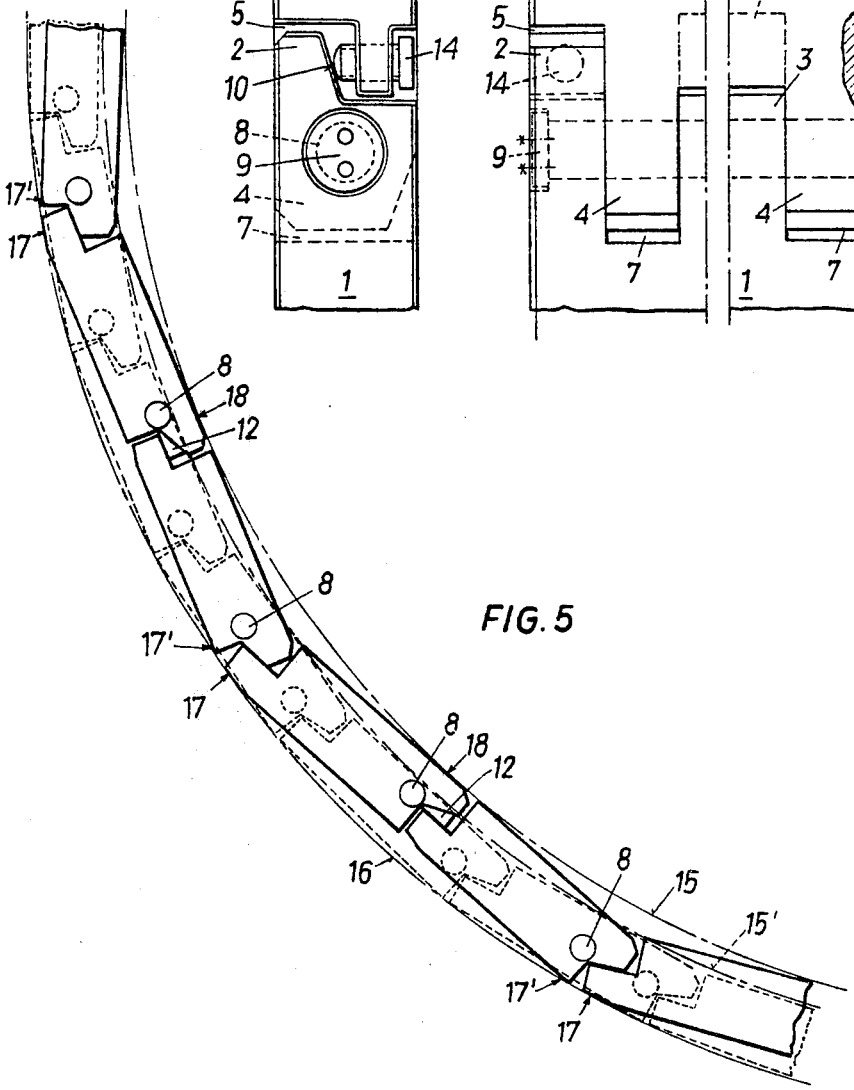
FIG. 5

STARTER BAR FOR GUIDING AND EXTRACTING CAST STRANDS OF VARIOUS THICKNESSES

BACKGROUND OF THE INVENTION

The invention relates to a starter bar for guiding and extracting cast strands of various thicknesses in continuous casting plants with arcuate guiding paths supporting the cast strand at opposite sides thereof. The bar is comprised of pivotally connected link bodies whose thickness corresponds to the smallest or slightest strand thickness of the cast strands.

In continuous casting plants one endeavours to extract cast strands of various thicknesses by using a bendable starter bar which can be used for all thicknesses of cast strands. This starter bar thus must have a thickness that corresponds to the slightest thickness of the strands to be cast. In continuous casting plants with arcuate strand guides there occur intermittent movements at the onset of casting when cast strands are extracted that have a greater thickness than the starter bar. This happens because the starter bar contacts the arc-inner strand guiding path when tensile forces act on it, and the arc-outer strand guiding path when compressive stresses act on it which forces or stresses are, caused by the lowering of the cast strand because of its weight as well as the weight of the starter bar. A continuous extraction is only possible when the frictional forces, which occur during the extraction and which counteract the extraction forces, are bigger than the forces caused by the weight of the cast strand and the starter bar and act in the extraction direction. The intermittent extraction therefore mainly occurs until the initial portion of the cast strand is in the area of the guiding path immediately following the mould.

Various proposals have been made for avoiding intermittent extractions of the initial portion of the cast strand. Thus a starter bar comprising link bodies has been provided with springs which, on the one hand, press sliding plates perpendicularly to the strand guiding path and, on the other hand, press the link bodies to the opposite strand guiding path. Although such a starter bar is guided without play independent of the distance between the opposing strand guiding paths, it is expensive and requires complex maintenance because of its many movable parts. Also, due to the spring forces, the friction present between starter bar and the strand guiding paths is greatly increased.

Furthermore, it is known to press a starter bar consisting of link bodies towards the opposite strand guiding path by individual pressure rollers arranged in one of the strand guiding paths. These pressure rollers are distributed over the longitudinal extension of the arcuate strand guide so that the starter bar is guided without play along one of the strand guiding paths. Making such a strand guiding path provided with pressure rollers is expensive and complex. Care must be taken so that no discontinuities in the strand guiding path occur because of the pressure rollers. For these reasons it is desirable to avoid pressure rollers in the strand guide as far as possible. A further disadvantage consists in that it is hardly possible to equip already existing plants with such pressure rollers.

SUMMARY OF THE INVENTION

The invention aims at avoiding these disadvantages and difficulties and has as its object to create a starter bar of the above-defined kind for a continuous casting plant with an arcuate strand guide, which starter bar allows for a uniform extraction of the cast strand during the start of casting without jerks. This means that the starter bar can be guided between the strand guiding paths without play, that its construction is as simple as possible and that it does not require resilient, movable parts.

According to the invention, these objects are achieved in that exchangeable articulation locking pieces are provided between individual ones of the link bodies arranged one behind the other for assuring the guiding of the starter bar between the guiding paths without play. The articulation locking pieces have the effect that two or more link bodies always form a starter bar section with restricted mobility, but the mobility between starter bar sections arranged one behind the other is fully maintained. These sections contact the arc-outer strand guiding path with their ends and the arc-inner strand guiding path with their middle portions, whereby the starter bar is guided in the strand guiding path without play.

According to a preferred embodiment, stop faces are provided at the ends of the link bodies arranged one behind the other and exchangeable spacers are insertable between these stop faces.

The construction is especially robust, if one stop face is slanted at one end of a link body and the pertaining spacer is wedge-shaped.

Advantageously, the spacers are laterally insertable and removable.

According to a further advantageous embodiment, adjusting screws are provided as articulation locking pieces.

BRIEF DESCRIPTION OF THE DRAWINGS

The invention shall now be described in greater detail by way of two embodiments and with reference to the accompanying drawings, wherein:

FIGS. 3 and 4 illustrate a starter bar according to another embodiment in illustrations analogous to FIGS. 1 and 2, and FIG. 5 schematically illustrates the starter bar sliding between the strand guides.

DESCRIPTION OF EXEMPLARY EMBODIMENTS

Figure 1:
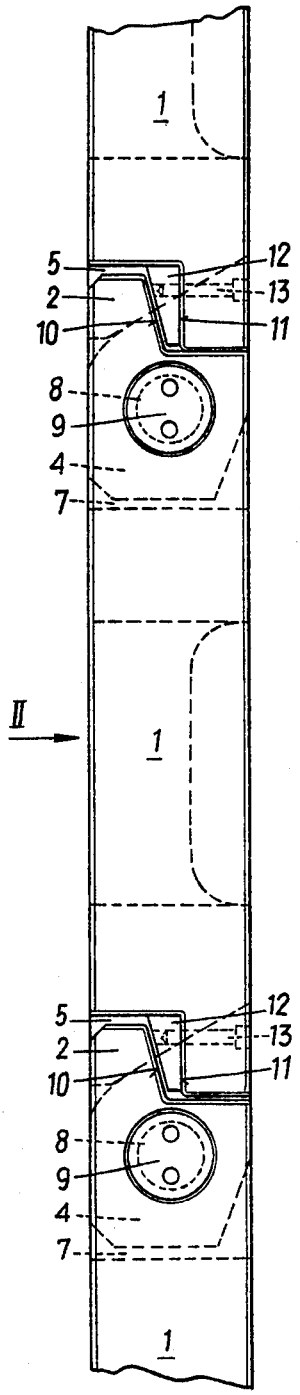
FIG. 1 is a side view of a starter bar.
Figure 2:
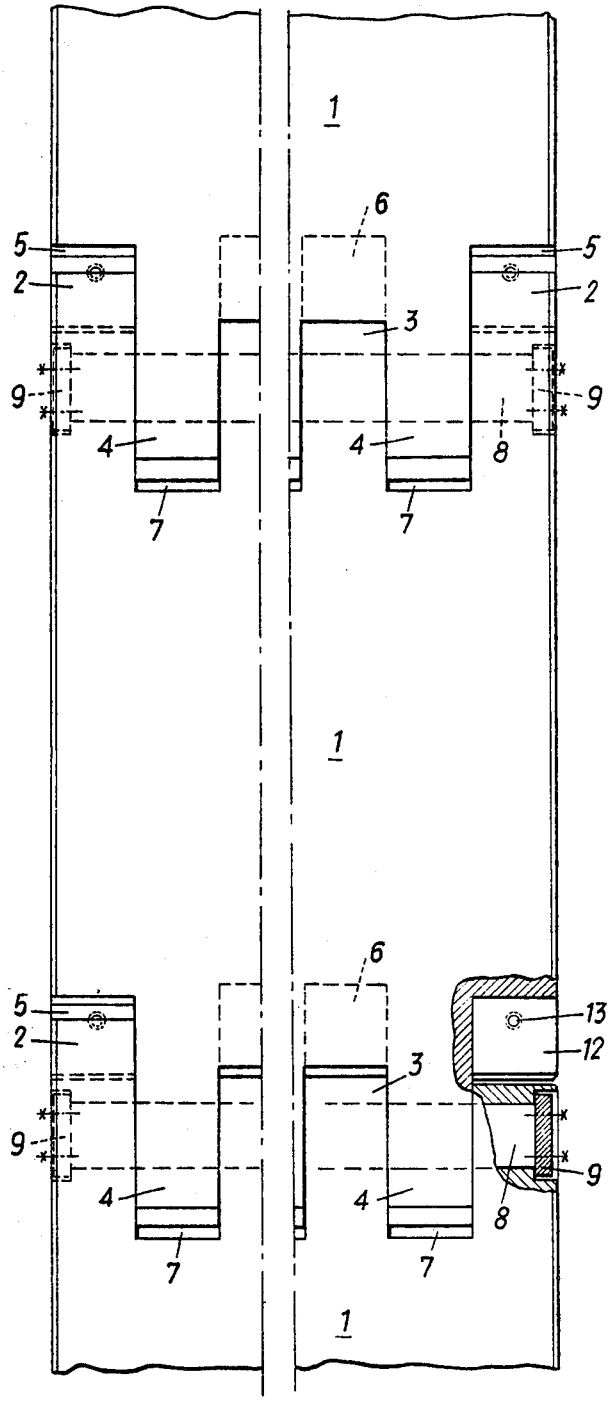
FIG. 2 is a view in the direction of the arrow II of FIG. 1 of the starter bar, partly in section.

Link bodies 1 of a starter bar have the same configuration and are provided with projections 2, 3 and 4 at their ends. The projections 2 and 3 engage in recesses 5 and 6 of the preceeding link body and projection 4 engages in recess 7 of the following link body. The link bodies 1 are pivotally connected to each other by a bolt 8, which bolt penetrates the engaging projections. The link bodies form a chain-like link band. Each bolt is secured against falling out by discs 9 screwed to its ends. The width of the link bodies corresponds to the greatest width of the cast strands and their thickness approximately corresponds to the smallest thickness of the cast strands. At the initial portion of the starter bar, a starter bar head is secured in a usual manner not illustrated.

The projections 2 arranged at the narrow sides of the link bodies are provided with stop faces 10, which are opposite to stop faces 11 arranged in the recesses 5 corresponding to the projections 2. Between the stop faces 10 and 11 exchangeable, wedge-shaped spacers 12 are inserted and are secured by screws 13. According to the embodiment illustrated in FIGS. 3 and 4, adjusting screws 14 are provided instead of the exchangeable spacers 12. Depending on the thickness of the spacers 12 selected or on the position of the adjusting screws 14, two neighbouring link bodies can be pivoted relative to each other to a greater or lesser degree around the mutual bolt 8.

FIG. 5 schematically illustrates the function of the starter bar. For extracting a cast strand of the slightest thickness — approximately corresponding to the thickness of the starter bar — the starter bar serves in the usual manner, entered in broken lines. The arc-inner guiding path 15 and the arc-outer guiding path 16 are illustrated as arcuate lines. They may be formed e.g. by rollers arranged closely behind each other.

If a cast strand having a greater thickness than the starter bar is to be extracted, at least two neighbouring link bodies are restricted in their mobility around their common bolt 8 by the insertion of the spacers 12 in such a manner that the starter bar sections formed in this manner contact the arc-outer guiding path 16 with their ends 17 and 17' and the arc-inner guiding path 15 with their middle portions 18. The mobility of the starter bar sections arranged one behind the other is not impeded by the spacers. This is illustrated in full lines. If cast strands having an even greater thickness are to be extracted, more than two link bodies can be united to form one starter bar section.

We claim:

1. In a starter bar for guiding and extracting cast strands of various thicknesses in continuous casting plants with arcuate guiding paths that support the cast strands at opposite sides thereof, the starter bar being formed by link bodies pivotally connected to one another about common axes so as to be arranged one behind the other and having a thickness corresponding to the slightest thickness of the cast strands, the improvement comprising exchangeable articulation locking pieces provided between individual ones of said link bodies for adjustably limiting the pivotal motion between connected link bodies about the common axes so as to assure guiding of the starter bar between the guiding paths without play.

2. A starter bar as set forth in claim 1 wherein stop faces are provided at both ends of the link bodies arranged one behind the other, the stop faces of a body being arranged opposite the stop faces of the body before and behind it, exchangeable spacers being provided as articulation locking pieces, which spacers are insertable between said opposite stop faces so as to limit pivotal motion between them about the common axes.

3. A starter bar as set forth in claim 2, wherein a stop face at one end of a link body is slanted and the pertaining spacer is wedge-shaped.

4. A starter bar as set forth in claim 2, wherein the exchangeable spacers are laterally installable and removable.

5. A starter bar as set forth in claim 1, wherein stop faces are provided at one end of each of the link bodies and adjusting screws are provided as articulation locking pieces, said screws being arranged at the other end of each of the link bodies so as to be able to contact the stop face of the adjoining link body and to limit pivotal motion between them.

* * * * *